E196Z XR 4,092,636

United States Patent [19]

Shepherd, Jr.

[11] 4,092,636

[45] May 30, 1978

[54] PROTECTIVE ALARM SYSTEM FOR WINDOW USING REFLECTED MICROWAVE ENERGY

[75] Inventor: Mark Shepherd, Jr., Dallas, Tex.

[73] Assignee: Texas Instruments Incorporated, Dallas, Tex.

[21] Appl. No.: 813,155

[22] Filed: Jul. 5, 1977

Related U.S. Application Data

[63] Continuation of Ser. No. 705,205, Jul. 14, 1976, abandoned, which is a continuation of Ser. No. 508,949, Sep. 24, 1974, abandoned, which is a continuation of Ser. No. 320,403, Jan. 2, 1973, abandoned.

[51] Int. Cl.[2] ..... G08B 13/08; G08B 13/04

[52] U.S. Cl. ..... 340/274 R; 250/222 R; 340/224; 340/258 D

[58] Field of Search ..... 340/274 R, 282, 280, 340/283, 224, 276, 258 B, 258 R, 258 D; 250/221, 222 R

[56] References Cited

U.S. PATENT DOCUMENTS

| | | | |
|---|---|---|---|
| 3,544,988 | 12/1970 | Astheimer | 340/282 |
| 3,665,443 | 5/1972 | Galvin | 340/258 R |
| 3,739,376 | 6/1973 | Keledy | 340/224 |
| 3,752,978 | 8/1973 | Kahl, Jr. et al. | 340/276 |

*Primary Examiner*—Glen R. Swann, III

*Attorney, Agent, or Firm*—James T. Comfort; John G. Graham

[57] ABSTRACT

A simplified protective system as for a home burglar alarm comprises a beam generator such as a solid state microwave module along with a detector and alarm or indicator. The beam generator and detector unit is positioned along a line-of-sight normal to a window or other object being monitored. A reflector such as a mirror on the window reflects the beam back to the detector. When the window is moved or broken, the beam does not reach the detector and the alarm is actuated.

1 Claim, 2 Drawing Figures

PROTECTIVE ALARM SYSTEM FOR WINDOW USING REFLECTED MICROWAVE ENERGY

This is a continuation of application Ser. No. 705,205, filed July 14, 1976, (now abandoned) which was a continuation of Ser. No. 508,949, filed Sept. 24, 1974 (now abandoned), which was a continuation of earlier-filed application Ser. No. 320,403, filed Jan. 2, 1973 (now abandoned).

BACKGROUND OF THE INVENTION

Homeowners and owners of small businesses are increasingly concerned about protecting buildings from intruders. Higher labor costs make it increasingly difficult to provide guards and patrol services, and so reliance on protective devices such as burglar alarms is necessary. Cost and reliability are major factors in selecting this type of equipment, as well as the desire to make the equipment as unobtrusive as possible. Windows may be protected by conductors taped to the glass, but devices of this type are rather unattractive, and the cost of installing may be high in materials and labor. Object detection schemes have been developed which make use of sound detection, light beam interruption, electromagnetic field interruption, etc., but these are of high cost and need to be carefully tuned and adjusted to avoid false alarms yet permit detection with reasonable reliability. Accordingly, a primary feature of this invention is that of providing a protective or intrusion detector technique for buildings or the like which is effective and reliable, yet of low cost and easily installed and operated.

SUMMARY OF THE INVENTION

In accordance with the invention, a protective system is provided by a beam generator and detector/alarm unit which is positioned at a location remote from the window, door or other object being monitored. The generator produces a directional beam which strikes a reflector on a surface of the object and is reflected back to the detector along a line-of-sight normal to the window. When the window is raised or broken, the beam will no longer reach the detector so the alarm will be energized.

THE DRAWINGS

Novel features believed characteristic of the invention are set forth in the appended claims; the invention itself, however, as well as further objects and advantages thereof, may best be understood from the following detailed description of particular embodiments, when read in conjunction with the accompanying drawings, wherein:

FIG. 1 is a pictorial representation of a system in accordance with the invention; and FIG. 2 is a block diagram of the system of FIG. 1.

DESCRIPTION OF SPECIFIC EMBODIMENT

Figure 1:
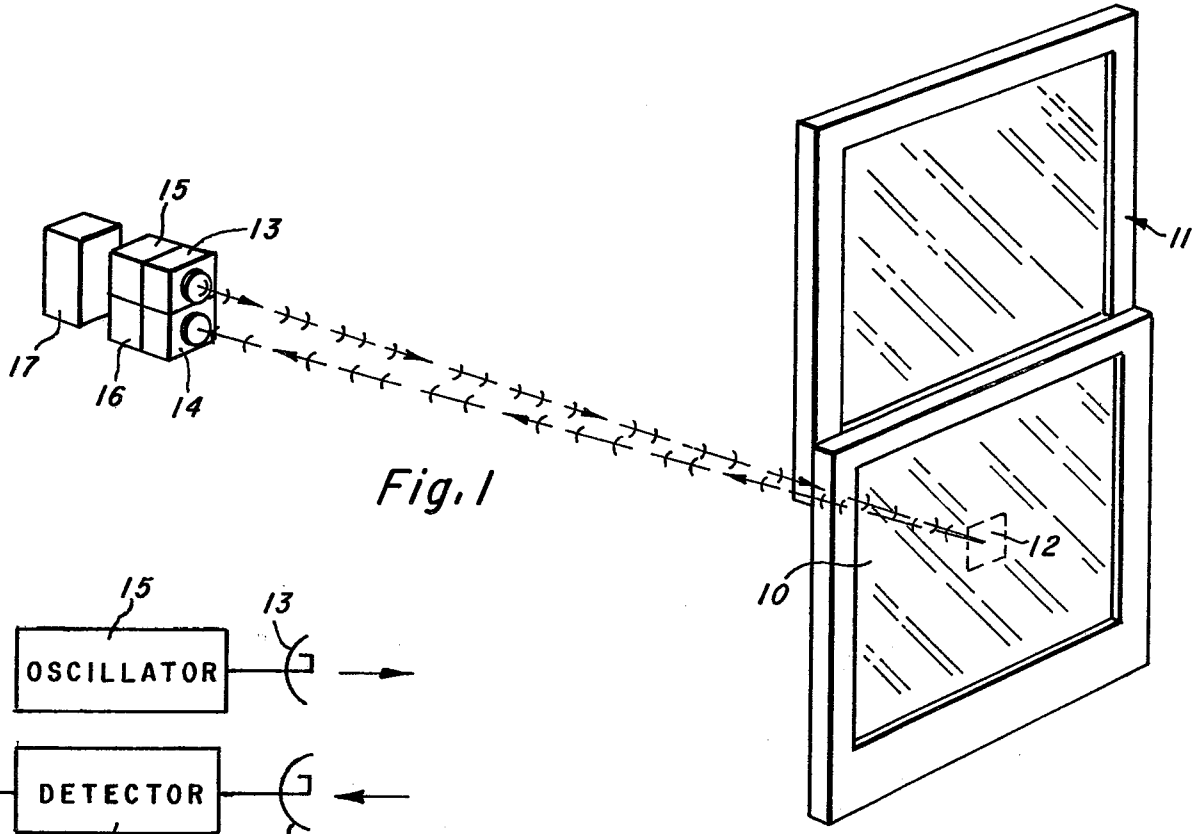

Referring to FIG. 1, one embodiment of the invention is shown which is effective for monitoring a pane 10 of glass in a window 11. A reflector 12 is mounted on the pane 10, and this reflector is positioned to receive a beam of radiation from a transducer or beam generator 13 as described hereinafter. The radiation is reflected back from the reflector 12 to strike a detector 14 which is responsive only to the radiation emitted by the transducer 13, and is highly directional so that radiation of the same type from other sources or reflected from other surfaces will not foil the system. The transducer and detector would be located at a position spaced away from the window, such as on a wall opposite the window, along a line-of-sight normal to the reflector. The housing in which the transducer and detector unit is mounted could be quite small and unobtrusive if it is desired to obscure the fact that an alarm system is being used, it being understood however that it sometimes acts as a deterrent to make obvious that the detector scheme is present in which case no effort would be made to hide the system.

Although other radiation sources may be used, the system will be described in terms of a microwave transducer and detector. In such case, the transducer 13 would be a directional microwave generator and antenna, and the antenna would be driven by a source 15 which is a microwave oscillator such as a solid state device or the like. For low cost and reliability, preferably an integrated solid state module would be used. In the most simple form, a continuous oscillator would be employed, but in a more elaborate system a pulse coded or variable frequency source may be employed, as will be referred to below.

Figure 2:
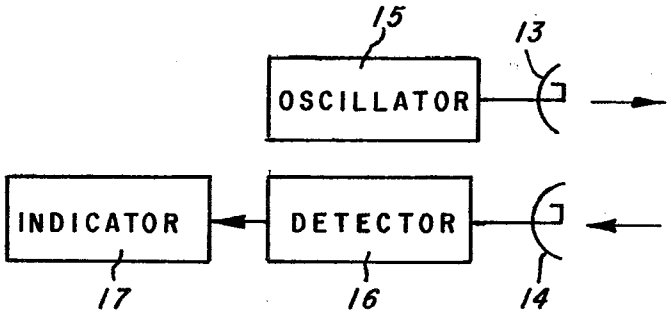

The detector 14 produces an output so long as the beam is reflected from the mirror or reflector 12 along the line-of-sight, and this output is applied to detector circuitry 16 as noted in FIG. 2 which functions to amplify and/or otherwise act on the signal produced by the detector 14 in such manner that an indicator 17 may be driven. The indicator may be an audible alarm such as a bell or buzzer, or visual such as flashing lights. In a commercial installation, the indicator may be at a central monitoring console, or at a remote location such as a police station or an office of a protective services agency. In such case, an indication may be a printout of location, or a display on a CRT.

The transducer 13 and detector 14 may well take the form of integrated circuit modules of the type disclosed in U.S. Pat. No. 3,417,393, issued Dec. 17, 1968, entitled INTEGRATED CIRCUIT MODULAR RADAR ANTENNA, assigned to Texas Instruments Incorporated, the assignee of this invention.

The detector circuitry 16 may include various means for discriminating or selecting signals. The source 15 might be pulse coded or the like so that the system could not be foiled by a simple broad-band microwave transmitter, for example. If the source is coded, then the detector circuitry 16 would need to be responsive to only such code.

In a preferred embodiment, however, for low cost and simplicity in operation, the source is continuous, and the detector merely responds to the presence or absence of the reflected beam. The reflection is sufficiently directive so that when the window is raised, moved or broken the detector will receive significantly less energy and the alarm will be actuated. The cost of the system and installation procedure is preferably minimized by using a simple reflector 12 in the form of a thin reflective sheet which may be attached by an adhesive. For microwave, the sheet would be conductive and thus a good reflector compared to glass. The source and detector would be in a single unit with the indicator or alarm, and the unit may be battery powered. It would be positioned by hand, guessing at the proper location then moving it around until the indicator stops thus showing that it is in the proper position.

Rather than using the system to detect breakage of a window, it may be employed to detect movement of a particular valuable piece of equipment or art object, in which case the mirror or reflector 12 would be mounted on the object in an appropriate unobtrusive position and the radiation-detector unit positioned on an adjacent wall or otherwise suitably located. The system also may be used to detect opening of elevator doors, or to detect movement of parts of machinery or workpieces as in an automated assembly line. Other applications include perimeter surveillance at military applications or the like.

Instead of the microwave module mentioned above, the system may use a GaAs infrared light emitter and a silicon photodetector, or an ultrasonic beam emitter such as a barium titanate transducer with corresponding receiver.

Although the invention has been described with references to illustrative embodiments, it is of course understood that various modifications of the disclosed embodiments, as well as other embodiments of the invention, will appear to persons skilled in the art upon reading this description. It is therefore contemplated that the appended claims will not be construed in a limiting sense but instead will cover any such modifications or embodiments as fall within the true scope of the invention.

What I claim in my invention is:

1. A protective alarm system for a transparent window for which movement or destruction is to be detected, comprising:

(a) generator means positioned on a wall opposite the window for generating a continuous beam of microwave energy and directing the beam toward the window;

(b) a thin, flat, mirror like device positioned on and adjesively attached to the window for reflecting the beam directionally;

(c) detector means positioned adjacent the generator means to receive the reflected beam and effective to generate an electrical signal indicative of the presence or absence of the reflected beam, the generator means and the detector means comprising a microwave integrated circuit module, the detector means and the generator means being positioned along a line-of-signt substantially normal to a surface of the window; and (d) indicator means coupled to the detector means and responsive to the signal to produce an indication of the absence of the reflected beam.

* * * * *